US006192310B1

(12) United States Patent
Marcheguet et al.

(10) Patent No.: US 6,192,310 B1
(45) Date of Patent: Feb. 20, 2001

(54) DEVICE AND METHOD FOR DIAGNOSING THE CONDITION OF A PROBE UPSTREAM FROM A CATALYTIC CONVERTER

(75) Inventors: Eric Marcheguet, Chatou; Vasco Afonso, Tremblay-en-France; Francois Ratinet, Limours, all of (FR)

(73) Assignee: Renault, Boulogne-Billancourt (FR)

( * ) Notice: Under 35 U.S.C. 154(b), the term of this patent shall be extended for 0 days.

(21) Appl. No.: 09/091,237

(22) PCT Filed: Oct. 18, 1996

(86) PCT No.: PCT/FR96/01631

§ 371 Date: Jul. 6, 1999

§ 102(e) Date: Jul. 6, 1999

(87) PCT Pub. No.: WO97/14876

PCT Pub. Date: Apr. 24, 1997

(30) Foreign Application Priority Data

Oct. 18, 1995 (FR) ..... 95 12238

(51) Int. Cl.[7] ..... F02D 41/14; F02D 41/22

(52) U.S. Cl. ..... 701/109; 60/276; 73/1.07

(58) Field of Search ..... 701/107, 109, 701/114; 123/688; 60/276; 73/1.06, 1.07

(56) References Cited

U.S. PATENT DOCUMENTS 5,341,642 * 8/1994 Kurihara et al. ..... 60/276
5,399,961 * 3/1995 Wild et al. ..... 123/688
5,656,765 * 8/1997 Gray ..... 60/276

* cited by examiner

*Primary Examiner*—Andrew M. Dolinar
(74) *Attorney, Agent, or Firm*—Oblon, Spivak, McClelland, Maier & Neustadt, P.C.

(57) ABSTRACT

An apparatus and method for diagnosing the condition of a sensor in an internal combustion engine upstream from the catalytic converter. The diagnosis utilizes a signal from a second non-linear probe downstream from the catalytic converter. This signal is processed to give a signal that is filtered. The filtered signal is in turn compared with maximum and minimum values. The upstream probe is considered to be correct if the signal falls between these two values or faulty if it falls outside the values.

14 Claims, 5 Drawing Sheets

DEVICE AND METHOD FOR DIAGNOSING THE CONDITION OF A PROBE UPSTREAM FROM A CATALYTIC CONVERTER

BACKGROUND OF THE INVENTION

1. Field of the Invention

The invention relates to internal combustion engines of the fuel-injection type equipped with a catalytic exhaust converter preceded by a sensor and, more particularly in such engines, a device and a process for diagnosis of the condition of the sensor disposed upstream from the catalytic converter.

2. Discussion of the Background

It is known how to use systems for modifying the quantity of fuel injected into an engine as a function of the exhaust-gas composition and, more particularly, of the oxygen content of these gases. To this end, the oxygen content is measured by means of a nonlinear sensor known as the "lambda" sensor or EGO sensor, where EGO is an English-language acronym for "Exhaust Gas Oxygen". Such a sensor is disposed upstream from the catalytic exhaust converter, and the signal delivered by this sensor is used to modify the quantity of fuel injected into the engine cylinders via a first feedback loop. For this reason, the sensor is also known as a richness-regulating sensor.

It is clear that poor condition of this sensor leads to poor operation of the engine and of the catalytic converter, in turn leading to pollutant emissions at abnormally high levels. It is therefore important to determine the condition of this sensor at all times in order to diagnose poor operation thereof when its condition has deteriorated beyond certain limits. The present solutions for diagnosis of the condition of the upstream sensor comprise analyzing the behavior of the sensor in response to richness excitations in open loop or closed loop and monitoring the following parameters:

- the minimum voltage delivered by the sensor: if too high, a fault is indicated;
- the maximum voltage delivered by the sensor: if too low, a fault is indicated;
- the lean-to-rich transition time; if too long, a fault is indicated;
- the rich-to-lean transition time; if too long, a fault is indicated;
- the period of the signal delivered by the sensor in closed loop: if too long, a fault is indicated.

The diagnosis then comprises declaring failure of the sensor if one or more faults are detected.

Such a diagnostic process is based on analysis of the sensor behavior in order co deduce therefrom a sensor condition on the basis of assumed degradation mechanisms. For example, as a sensor ages, its dynamic voltage range is reduced and/or its transition times become longer The disadvantage of such a diagnostic process is that a perfect correlation does not exist between these measurements and the emissions of pollutants.

In addition, calibration of fault detection thresholds proves to be very tricky and necessitates:

- perfect knowledge of the mechanisms of aging of the sensors,
- numerous tests to establish a relationship between the measured degradations of parameters and their effects on pollutant emissions.

In addition, it is not possible in all cases to guarantee that the diagnosis is reliable. For example, a sensor with reduced dynamic voltage range may prove to be good with regard to pollutant emission if only that characteristic is affected.

SUMMARY OF THE INVENTION

One object of the present invention is therefore to provide, for diagnosis of the condition of a sensor disposed upstream from a catalytic converter associated with an internal combustion engine of the fuel-injection type, a device and a process which do not exhibit the aforesaid disadvantages of the devices and processes of the prior art.

Another object of the present invention is also to provide, for diagnosis of the condition of an upstream sensor, a device and a process which does not depend on measurements of intrinsic characteristics of the sensor. The process of the invention is based on monitoring of characteristics of the richness feedback loop which have an influence on pollutant emission, or in other words the mean period and mean richness of the feedback loop. In this way, the condition of the upstream sensor is evaluated on the basis of effects that it produces on the richness feedback loop, or in other words on the emissions of pollutants, and not on the basis of its intrinsic characteristics.

The effects of the condition of the upstream sensor are capable of causing pollutant emissions by exceeding the limits of the "window" of good operation of the catalytic converter, this exceeding being due to drift of the mean operating richness and/or to excessively long mean period of the richness loop.

To detect drift of the mean operating richness, the invention proposes to provide a second nonlinear sensor disposed downstream from the catalytic converter and constituting an integral part of a second feedback loop, by virtue of which the output voltage $V_{downstream}$ of the second sensor, called downstream sensor hereinafter, is slaved to a setpoint voltage $VC_{downstream}$ corresponding to the center of the window of good operation of the catalytic converter. The signal delivered by this loop is used to modify the signal of the first feedback loop containing the upstream sensor.

Such a system of richness slaving with double control loop is described in the patent application filed today by the Applicant and entitled: "SYSTEM AND PROCESS WITH DOUBLE CONTROL LOOP FOR INTERNAL COMBUSTION ENGINE". The invention relates to a device for diagnosis of the condition of a nonlinear sensor disposed upstream from a catalytic converter associated with an internal combustion engine of the fuel-injection type controlled by an electronic computer, the said engine containing a first control loop, including the said nonlinear sensor, to deliver to the computer a first signal KCL for correction of the quantity of fuel injected, and a second control loop, including a second nonlinear sensor disposed downstream from the said catalytic converter, to deliver a second signal KRICH for correction of the quantity of fuel injected, the said diagnostic device being characterized in that it comprises:

- a filter circuit to which there is applied the second correction signal KRICH in order to deliver a filtered signal $KRICH_F$,
- a measuring circuit to which there is applied the output signal $V_{upstream}$ of the upstream sensor in order to determine the mean value $T_m$ of the period of correction of the first control loop, and
- a logic circuit to determine, as a function of the values of the filtered signal $KRICH_F$ and of the mean period $T_m$, whether the condition DIAG of the upstream sensor is good or defective.

In one embodiment of the invention, the logic circuit determines that the upstream sensor is defective if the filtered signal is larger than a maximum value or smaller than a minimum value or else if the mean period is longer than a maximum value.

In another embodiment of the invention, the maximum and minimum values of the filtered signal $KRICH_F$ are determined by calibration as a function of the value of the mean period and are stored in a memory. This memory is addressed by the value of the mean period in order to deliver the maximum and minimum values, with which the value of the filtered signal is compared.

The invention also relates to a process which comprises the following stages:

filtering of the second correction signal KRICH to obtain a filtered signal $KRICH_F$, calculation of the mean value $T_m$ of the period of the output signal $V_{upstream}$ of the upstream sensor, comparison of the said filtered signal $KRICH_F$ with two values, the maximum $KRICH_{max}$ and the minimum $KRICH_{min}$, to determine whether the condition DIAG of the said upstream sensor is correct or defective, according to whether the filtered signal $KRICH_F$ is respectively within the limits defined by the maximum and minimum values or outside the said limits for the value of the mean period $T_m$.

BRIEF DESCRIPTION OF THE DRAWINGS

Other characteristics and advantages of the present invention will become apparent upon reading the following description of a particular embodiment, the said description being made with reference to the attached drawings, wherein.

DETAILED DESCRIPTION OF THE PREFERRED EMBODIMENTS

Figure 1:
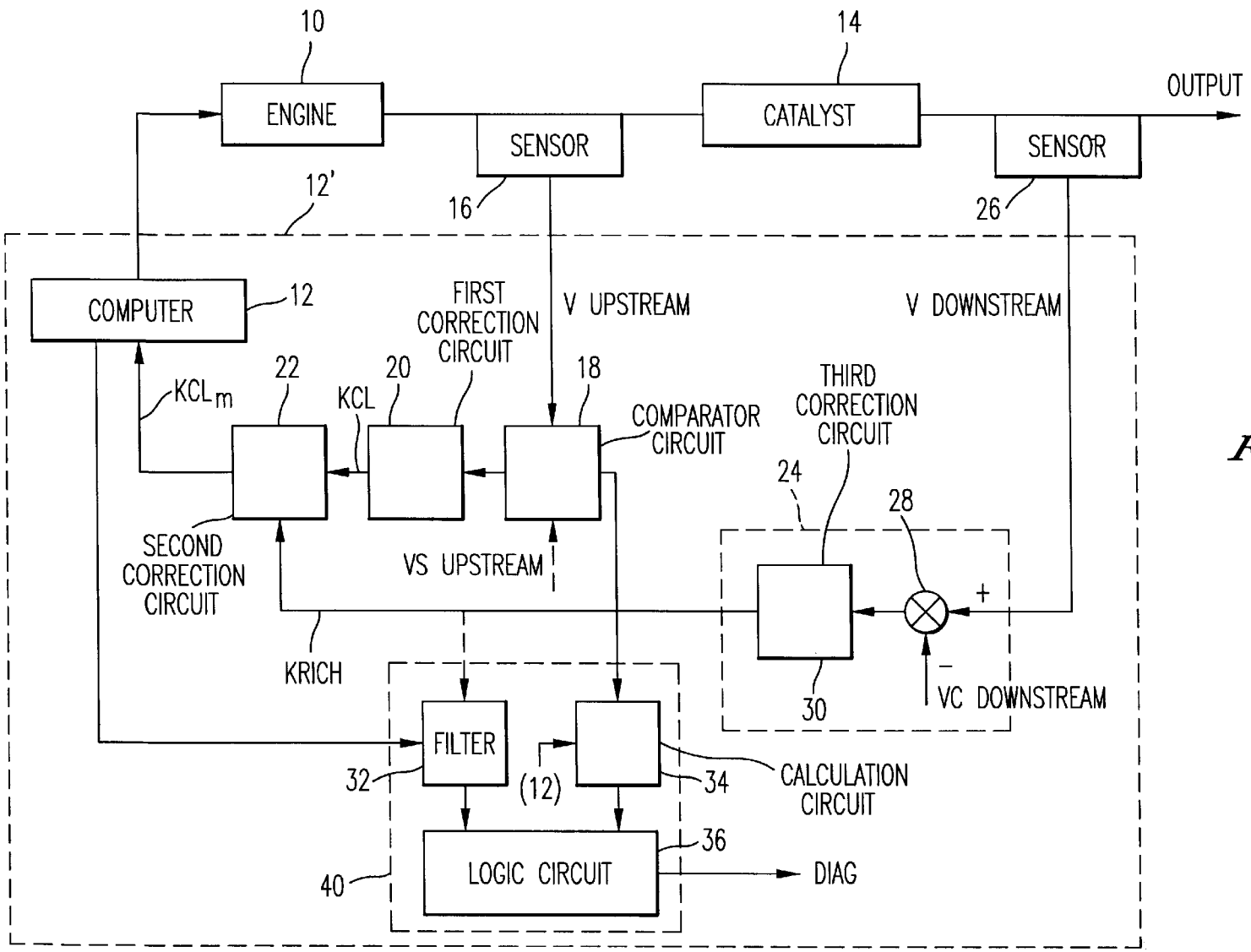
FIG. 1 is a functional diagram of a system for double-loop control of richness to which the invention applies.
Figure 2A:
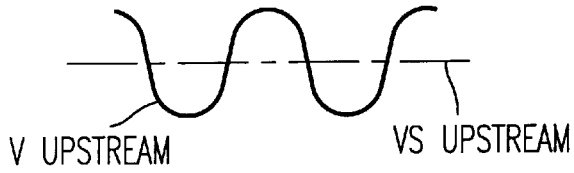
FIGS. 2-A and 2-B are diagrams showing how the richness correction is applied with a single feedback loop containing one sensor upstream from the catalytic converter.
Figure 2B:
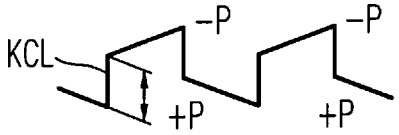

In FIG. 1, an internal combustion engine 10 is controlled in known manner by an electronic computer 12. The exhaust gases of this engine are filtered by an exhaust muffler 14 of the catalytic converter type, from which they escape to the open air. A first sensor 16 is disposed at the inlet of the exhaust muffler and measures the content of one of the main components of the exhaust gases, this component usually being oxygen. This sensor is of the nonlinear type, and is often called, as indicated hereinabove, a "lambda" sensor or EGO sensor. This sensor delivers at its output terminal an electric signal $V_{upstream}$ (FIG. 2-A), which is applied to a comparator circuit 18 in which $V_{upstream}$ is compared with a threshold voltage $VS_{upstream}$ to determine the sign of $V_{upstream}$ relative to that threshold.

The threshold value $VS_{upstream}$ depends on the sensor characteristics and corresponds to the transition voltage of the sensor when the conditions of stoichiometry are satisfied.

The output terminal of comparator circuit 18, which delivers a binary signal 1 or 0, is connected to the input terminal of a first richness-regulating correction circuit 20 of the proportional-plus-integral type with gains P and I respectively. The correction circuit 20 delivers a signal KCL, which has the shape represented by the diagram of FIG. 2-B. It is this signal KCL which is delivered to computer 12 to control the quantity of fuel to be injected. Thus, as soon as $V_{upstream}$ becomes smaller than $VS_{upstream}$, this means that the mixture is lean in fuel and that the quantity of fuel must be increased. This is accomplished by the jump +P (FIG. 2-B) followed by a positive slope of value I until the instant that $V_{upstream}$ exceeds $VS_{upstream}$, which means that the mixture has become rich in fuel and that the quantity thereof must be reduced. This is accomplished by a jump −P followed by a negative slope of value I.

The correction value KCL delivered by correction circuit 20 is modified by a second correction circuit 22, which introduces a correction term KRICH before being applied to computer 12. This correction term KRICH is determined by a circuit 24 on the basis of an output signal $V_{downstream}$ of a second lambda sensor 26, which is disposed at the outlet of the catalytic exhaust converter 14. This circuit 24 substantially comprises a comparator 28, to which there are applied the signal $V_{downstream}$ and a setpoint signal denoted by $VC_{downstream}$, and a third correction circuit 30, to which there is applied the signal ($V_{downstream}-VC_{downstream}$) delivered by comparator circuit 28. The third correction circuit 30 is, for example, of the proportional plus integral type, and delivers the signal KRICH, which is applied to the second correction circuit 22.

The second correction circuit 22 is able to introduce the correction KRICH by different modes, one of which will be explained with reference to the timing diagrams of FIGS. 3-A and 3-B. These diagrams are plots of the signal KCL as modified by the second correction circuit 22, the modified signal KCL being denoted by $KCL_m$.

Figure 3A:
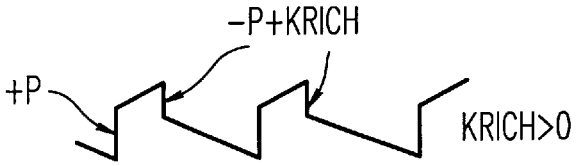
FIGS. 3-A and 3-B are diagrams showing one mode of correction of the richness by using a second feedback loop containing a sensor downstream from the catalytic converter.
Figure 3B:
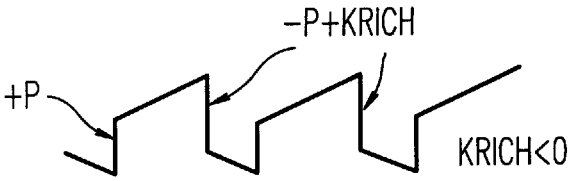

According to the diagrams of FIGS. 3-A and 3-B, the signal KRICH is applied during lean-to-rich transitions detected by the first sensor, which corresponds to the descending side of the signal KCL. In the case in which KRICH>0 (increasing the richness), the plot of $KCL_m$ is that of FIG. 3-A, while in the case in which KRICH<0 (increasing the leanness), the plot of $KCL_m$ is that of FIG. 3-B.

The device for diagnosis of the condition of sensor 16 comprises the elements represented inside the rectangle 40 of the diagram of FIG. 1. These are a filter 32, to which there is applied the output signal KRICH of correction circuit 24 of the second loop, as well as a circuit 34 for calculation of the mean period $T_m$ of the signal $V_{upstream}$ of the upstream sensor 16. The output terminals of filter 32 and of calculation circuit 34 are connected to a logic circuit 36, which determines whether the condition of sensor 16 is good or poor as a function of the output signal $KRICH_F$ of filter 32 and of the value $T_m$ of the mean period of the signal $V_{upstream}$. The binary signal 1 or 0 corresponding to good or poor condition of sensor 16 appears at the output terminal DIAG of logic circuit 36.

The communications delivered by computer 12 are as follows:

the engine speed REG, the pressure P of the intake manifold,
the state of the first loop: active or inactive,
the state of the second loop: active or inactive.

Figure 4:
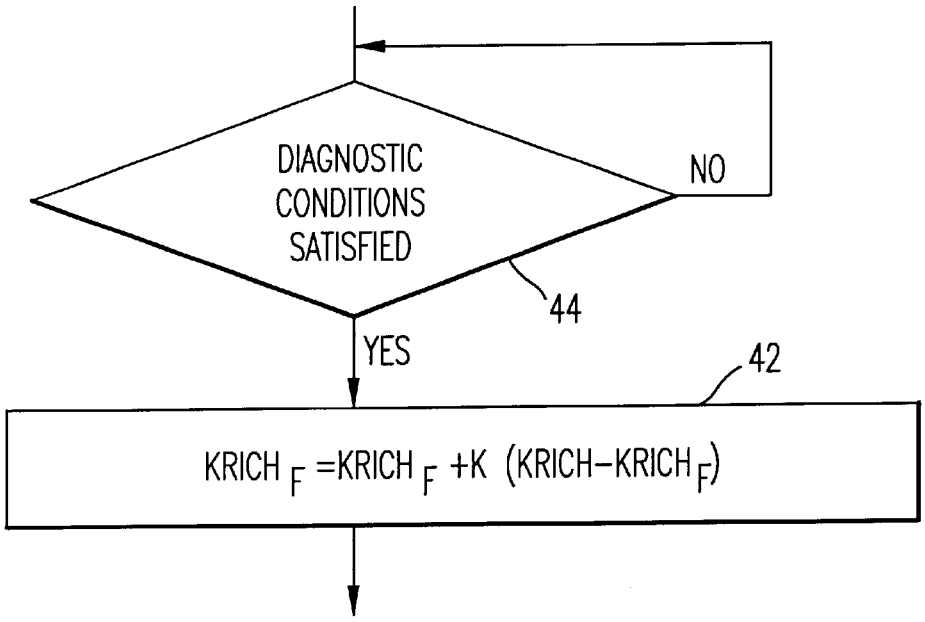
FIG. 4 is a diagram showing the mode of filtering of the correction signal KRICH to obtain a filtered signal $KRICH_F$.

Circuits 32 and 34 process the communications listed above and authorize filtering and calculation of $T_m$ only if the following conditions are satisfied simultaneously:

$REG_{min}<REG<REG_{max}$ $P_{min}<P<P_{max}$ first loop in active state, second loop in active state, where $REG_{min}$ and $REG_{max}$ are respectively the minimum and maximum values of engine speed REG between which the diagnosis can be made; $P_{min}$ and $P_{max}$ are respectively the minimum and maximum values of the pressure P of the intake manifold between which the diagnosis can be made. Filter circuit 32 performs the calculation of the filtered richness correction $KRICH_F$ according to the algorithm of FIG. 4. This calculation (step 42) is performed only if the conditions listed above are satisfied (step 44) and, in this case, the mean richness $KRICH_F$ is given by:

$KRICH_F=KRICH_F+K(KRICH-KRICH_F)$ where K is a filter factor between 0 and 1.

Figure 5:
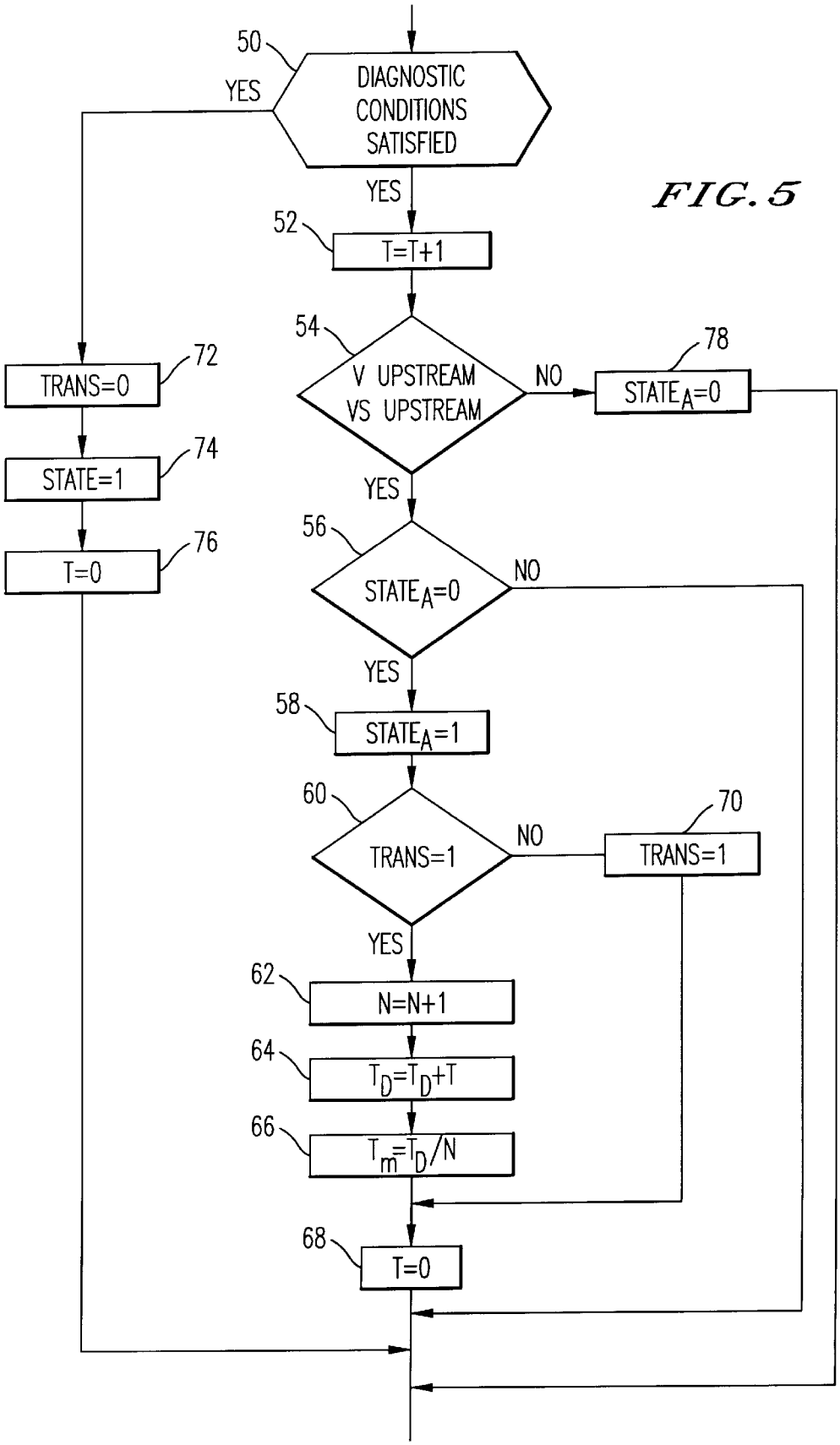
FIG. 5 is a diagram showing an algorithm for calculation of the mean period of the signal of the upstream sensor.

Calculation circuit 34 performs the calculation of the mean period $T_m$ according to the algorithm of FIG. 5. This calculation is performed only if the conditions listed above are satisfied (step 50). This calculation of the mean period $T_m$ comprises counting the transitions of the voltage $V_{upstream}$ from a value smaller than the threshold $VS_{upstream}$ to a value larger than the threshold during a certain time interval $T_D$ and dividing this interval $T_D$ by the number N of transitions that were detected. The algorithm for calculation of the mean period $T_m$ of the first loop is represented by the diagram of FIG. 5. The first step (50) comprises verifying whether the diagnostic conditions listed above are satisfied. If the response is "YES", counting step 52 for time T is started, or in other words the calculation of the mean period $T_m$ begins. As soon as $V_{upstream}>VS_{upstream}$ (step 54) and the sensor's previous state, $STATE_A$, corresponding to $V_{upstream}<VS_{upstream}$ ($STATE_A=0$), step 58 comprises storing this new state of the sensor in memory as $STATE_A=1$. The following step 60 comprises verifying whether a transition (TRANS=1) was already detected previously; if the response is positive, this means that a period has elapsed and the count 62 of the number N of periods is incremented by one unit. At the same time, the counter of the duration $T_D$ of the diagnosis is incremented by the value T of the counter 52. The calculation 66 of the mean period $T_m=T_D/N$ is then performed with the new values of N and $T_D$. The following step 68 resets counter 52 to zero for a new measurement T of the period in progress.

In order that the calculation described in the foregoing can be performed correctly, the following states must be present: TRANS=0, $STATE_A=1$ and T=0, which is accomplished by steps 72, 74 and 76 in cascade, which are initialized by the verification (step 50) that the diagnostic conditions are not satisfied, which is always the case during starting of the engine. Thus, for the first measurement of the period, the counter 52 is at the value 0 but, since $STATE_A=1$, the calculation cannot begin until this state changes to $STATE_A=0$, in order to be certain of detecting a transition In the desired direction. This is obtained by the detection that $V_{upstream}<VS_{upstream}$, in which case the change to $STATE_A=0$ takes place (step 78).

During starting, TRANS=0, and so the condition of step 60 is not satisfied and the period cannot be calculated. Otherwise, step 70 imposes TRANS=1, which resets counter 52 to zero via step 68, and a new count of T can begin.

During starting, $STATE_A=1$, and so the condition of step 56 is not satisfied, in which case the steps of the algorithm begin over again.

Figure 7:
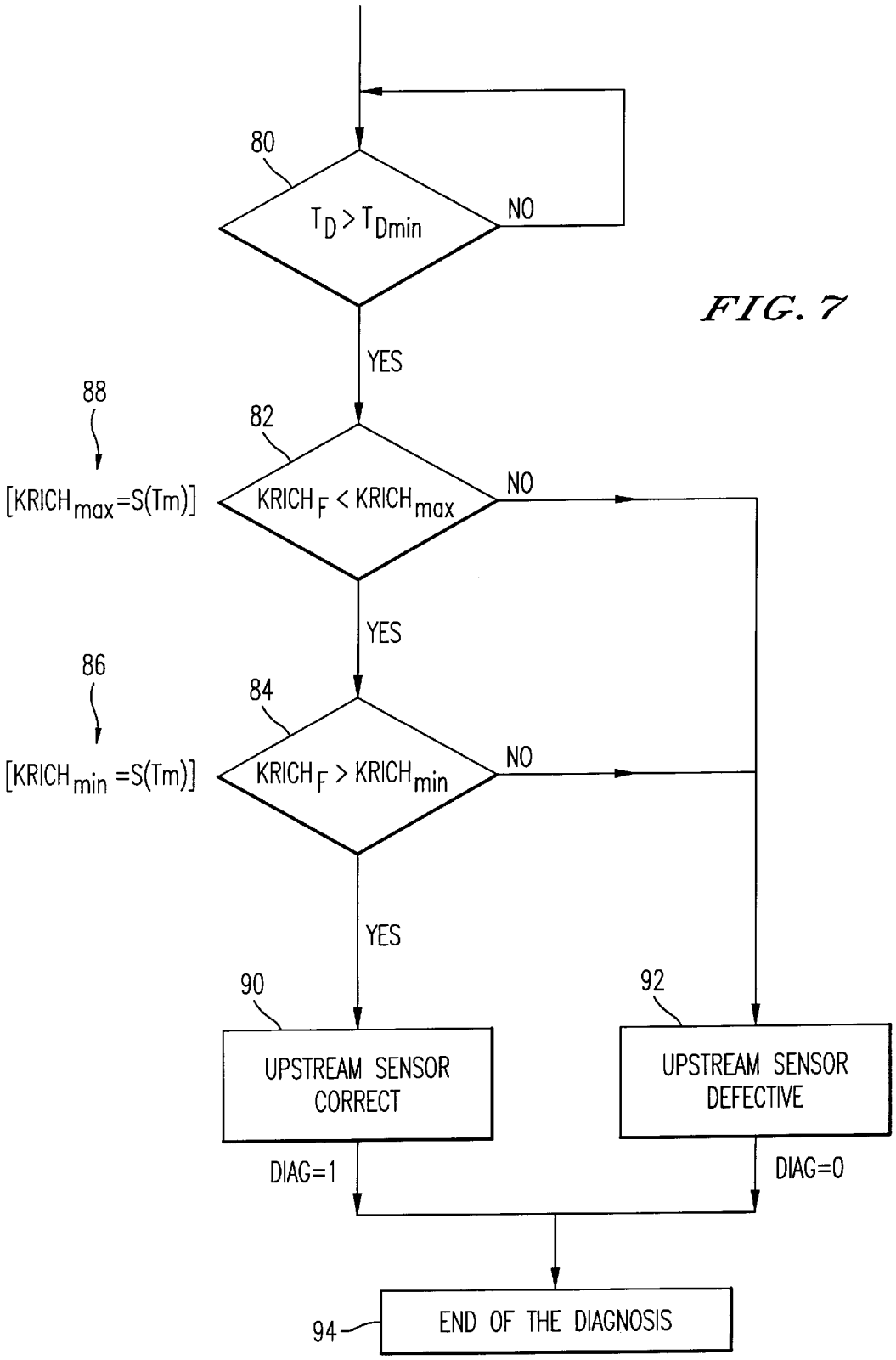
FIG. 7 is a diagram showing a decision algorithm for determining the condition of the upstream sensor.

Logic circuit 36 performs the steps of the algorithm of FIG. 7 in order to compare the value of $KRICH_F$ with values determined as being the limit values beyond which the sensor is considered to be defective, specifically for a determined value $T_m$ of the mean period.

These limit values, denoted by $KRICH_{max}$ for too large richness increase and $KRICH_{min}$ for too large leanness increase, are determined by calibration with the use of a series of sensors whose aging characteristics are known.

Figure 6:
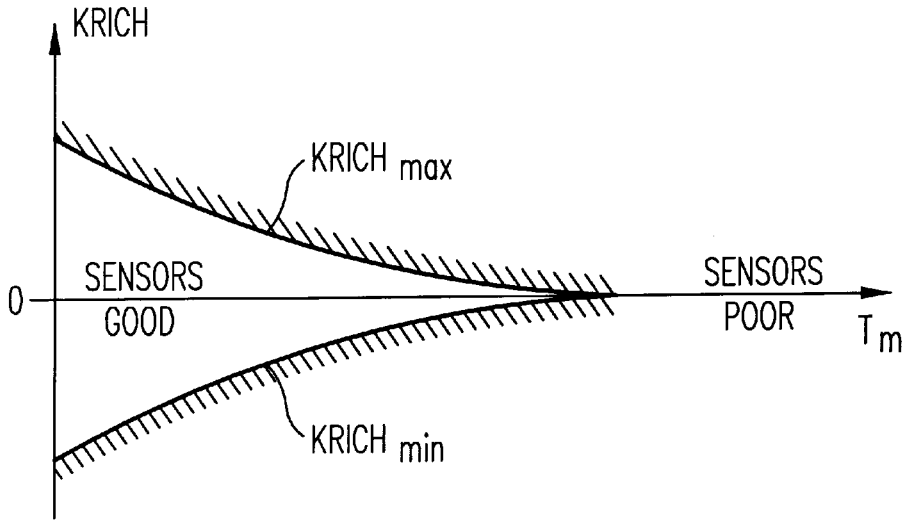
FIG. 6 is a diagram showing the curves which define the zones of correct or defective functioning of the upstream sensor.

This calibration permits plotting of the curves $KRICH_{max}$ and $KRICH_{min}$ as a function of the period $T_m$ (FIG. 6), and these curves can be stored in memory in the form of two maps or of a single map that consolidates both curves. These maps can be constructed by memories which are addressed by the value of Tm, and the values read are $KRICH_{max}$ and $KRICH_{min}$ corresponding to the value of $T_m$ (FIG. 6).

The first step 80 of the diagnostic algorithm comprises comparing the duration $T_D$ for calculation of the period $T_m$ to a minimum duration $T_{Dmin}$, shorter than which a diagnosis would not be reliable. If $T_D>T_{Dmin}$, the following step 82 comprises comparing $KRICH_F$ with a value $KRICH_{max}$ read from the map 88 giving $KRICH_F=S(T_m)$. This map is addressed by the value of $T_m$ to obtain a value of $KRICH_{max}$, which is compared with $KRICH_F$. If the condition is not verified, the sensor is considered to be defective (step 92).

If the condition is verified, the following step 84 is to compare $KRICH_F$ with the value of $KRICH_{min}$ for $T_m$ as read from map 86, in which there are stored the values of the curve $KRICH_{min}=S(T_m)$. If the condition $KRICH>KRICH_{min}$ is not verified, the sensor is considered to be defective (step 92), with DIAG=0. In the opposite case, the sensor is considered to be correct (step 90), with DIAG=1.

As soon as the sensor is considered to be correct or defective, the diagnosis is terminated (step 94) and a new diagnosis can be initiated to obtain a new value of $KRICH_F$ and of $T_m$.

When the curves of FIG. 6 are reduced to the form of maps, and the algorithm of FIG. 7 is applied, the sensors considered to be poor (DIAG=0) are in the shaded portion outside the two curves, and the sensors considered to be good (DIAG=1) correspond to the area between the curves.

Instead of the two curves of FIG. 6, it is possible to limit the choice to fixed thresholds for $KRICH'_{max}$, $KRICH'_{min}$ and $T'_{max}$, and so it is no longer necessary to have two maps. In this simplified case, the value of $KRICH_F$ is compared with the two chosen thresholds, while the value $T_m$ of the mean value is compared with the threshold $T'_{max}$. If $KRICH_F$ is larger than $KRICH'_{max}$ or smaller than $KRICH'_{min}$ or larger than $T'_{max}$, the sensor is considered to be defective. In the opposite case, the sensor is considered to be good.

The algorithm of FIG. 7 can be implemented in the form of a software routine or in the form of electronic circuits, in which the comparison steps 80, 82 and 84 would be accomplished by digital comparators.

What is claimed is:

1. A device for diagnosis of the condition of a nonlinear sensor disposed upstream from a catalytic converter associated with a fuel injected internal combustion engine controlled by an electronic computer, the engine containing a first control loop, including said nonlinear sensor, to deliver to the computer a first signal for correction of a quantity of fuel injected, and a second control loop, including a second nonlinear sensor disposed downstream from the catalytic converter, to deliver a second signal for correction of the quantity of fuel injected, said diagnostic device comprising:

a filter circuit to which there is applied the second correction signal in order to deliver a filtered signal, a measuring circuit to which there is applied an output of the upstream sensor in order to determine the mean value of the period of correction of the first control loop, and a logic circuit to determine, as a function of the values of the filtered signal and of the mean period, whether the condition of the upstream sensor is good or defective.

2. A diagnostic device according to claim 1, wherein the filter circuit accomplishes first-order filtering.

3. A diagnostic device according to claim 2, characterized in that the filter circuit is of digital type.

4. A diagnostic device according to claim 2, characterized in that the circuit for calculation of the mean value of the correction period of the first control loop is of the digital type.

5. A diagnostic device according to claim 2, characterized in that the logic circuit comprises three comparators, the first of which compares the value of the filtered signal with a maximum value in a first comparator, the second compares the value of the filtered signal with a minimum value, and the third compares the value of the mean period with a maximum value, the upstream sensor being considered to be defective when the value of the filtered signal is larger than the maximum value or smaller than the minimum value or larger than the maximum value of the mean period.

6. A diagnostic according to claim 1, wherein the filter circuit is a digital filter.

7. A diagnostic device according to claim 6, characterized in that the circuit for calculation of the mean value of the correction period of the first control loop is of the digital type.

8. A diagnostic device according to claim 6, characterized in that the logic circuit comprises three comparators, the first of which compares the value of the filtered signal with a maximum value in a first comparator, the second compares the value of the filtered signal with a minimum value, and the third compares the value of the mean period with a maximum value, the upstream sensor being considered to be defective when the value of the filtered signal is larger than the maximum value or smaller than the minimum value or larger than the maximum value of the mean period.

9. A diagnostic device according to claim 1, wherein the measuring circuit for calculation of the mean value of the correction period of the first control loop is a digital circuit.

10. A diagnostic device according to claim 9, characterized in that the logic circuit comprises three comparators, the first of which compares the value of the filtered signal with a maximum value in a first comparator, the second compares the value of the filtered signal with a minimum value, and the third compares the value of the mean period with a maximum value, the upstream sensor being considered to be defective when the value of the filtered signal is larger than the maximum value or smaller than the minimum value or larger than the maximum value of the mean period.

11. A diagnostic device according to claim 1, wherein the logic circuit comprises three comparators, a first of which compares the value of the filtered signal with a maximum value , a second of which compares the value of the filtered signal with a minimum value, and a third of which compares the value of the mean period with a maximum value of the mean period, the upstream sensor being considered to be defective when the value of the filtered signal is larger than the maximum value or smaller than the minimum value or larger than the maximum value of the mean period.

12. A diagnostic device according to claim 11, wherein the logic circuit comprises at least one map or memory in which there arc stored the maximum and minimum values of the filtered signal as a function of the value of the mean periods and two comparators, a first of which compares the value of the filtered signal with a maximum value read from the map, and a second of which compares the value of the filtered signal with a minimum value read from the map, reading from the map being accomplished by means of the mean period.

13. A process for diagnosis of the condition of a nonlinear sensor disposed upstream from a catalytic converter associated with a fuel injected internal combustion engine controlled by an electronic computer, the engine containing a first control loop, including the nonlinear sensor, to deliver to the computer a first signal for correction of a quantity of fuel injected, and a second control loop, including a second nonlinear sensor disposed downstream from the said catalytic converter, to deliver a second signal for correction of the quantity of fuel injected, the diagnostic process comprising the steps of:

filtering the second correction signal to obtain a filtered signal, calculating the mean value of the period of the output signal of the upstream sensor, comparing the filtered signal with predetermined maximum and minimum values of the filtered signal, to determine whether the condition of the upstream sensor is correct or defective, according to whether the filtered signal is respectively within the limits defined by the maximum and minimum values, or outside predetermined limits for the value of the mean period.

14. A diagnostic process according to claim 13, further comprising the steps of:

calibrating to determine maximum and minimum values for a plurality of values of the mean period, storing said maximum and minimum values as well as values of the mean period in a memory addressable via its contents, and reading said memory by means of the mean value of the period to obtain the maximum and minimum values of the mean period.

* * * * *